United States Patent [19]

Luft

[11] 4,346,521

[45] Aug. 31, 1982

[54] MODERN SUNDIAL

[76] Inventor: Peter A. Luft, 1870 Sacramento #314, San Francisco, Calif. 94109

[21] Appl. No.: 4,172

[22] Filed: Jan. 17, 1979

[51] Int. Cl.[3] ..... G04B 49/00

[52] U.S. Cl. ..... 33/269

[58] Field of Search ..... 33/269, 270, 271

[56] References Cited

U.S. PATENT DOCUMENTS

| | | | |
|---|---|---|---|
| 89,585 | 5/1869 | Johnson | 33/270 |
| 303,118 | 8/1884 | Christian | 33/270 |
| 783,245 | 2/1905 | Clarke | 33/270 |
| 794,787 | 7/1905 | Crehore | 33/270 |
| 1,651,621 | 12/1927 | O'Sullivan | 33/270 |
| 2,072,565 | 3/1937 | Moehle | 33/270 |
| 2,846,768 | 8/1958 | Putnam | 33/270 |
| 3,417,473 | 12/1968 | Troseth | 33/269 |

*Primary Examiner*—William D. Martin, Jr.

[57] ABSTRACT

The disclosure relates to a sundial employing a new type of gnomon comprising an opaque design printed on a plate of transparent material. The sundial described is designed for use in a specific locale, thereby enabling greater accuracy. The design of the casing of the sundial is therefore influenced by the choice of where it is to be used.

2 Claims, 2 Drawing Figures

MODERN SUNDIAL

SUMMARY

Described herein is a modern sundial. This sundial displays the standard time and date of the specific locale for which it is designed to be used. It is new in the manner in which it incorporates a shadow casting mechanism in the form of a glass plate with an opaque star printed on it, and it is new in the design of the case which holds said plate above a second plate of opaque plexiglass with calibrated hour and date lines printed on it. This case holds both plates perpendicular to the plane of the celestial equator at the latitude of said locale, for reasons which follow in the detailed description. Finally, the sundial incorporates an additional new feature in the form of a rigid aluminum bar which is fastened to the back of the plexiglass dial plate, and supported by the case, to prevent the plexiglass from warping under the heat of the sun, and also to allow the dial plate to be easily aligned.

DRAWINGS

Reference is now made to the accompanying drawings, which form a part of this specification.

FIG. one is a perspective view of the front of the sundial.

FIG. two is a perspective view of the back of the sundial, which is shown resting upside-down.

DETAILED DESCRIPTION

Figure 1:
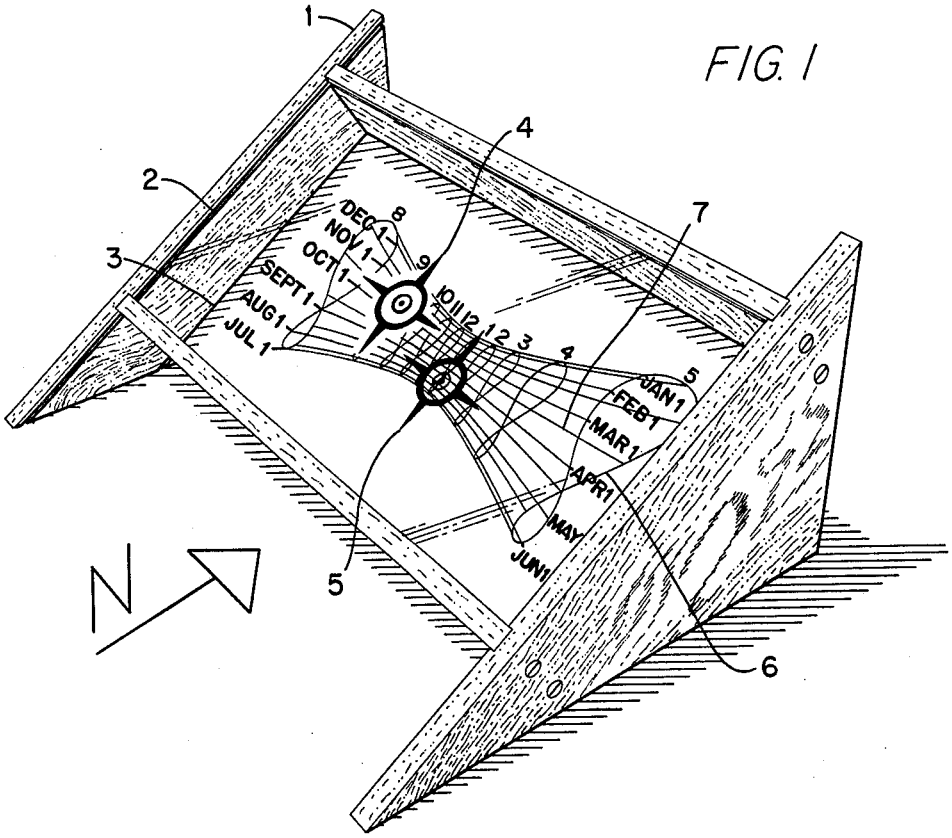
Figure 2:
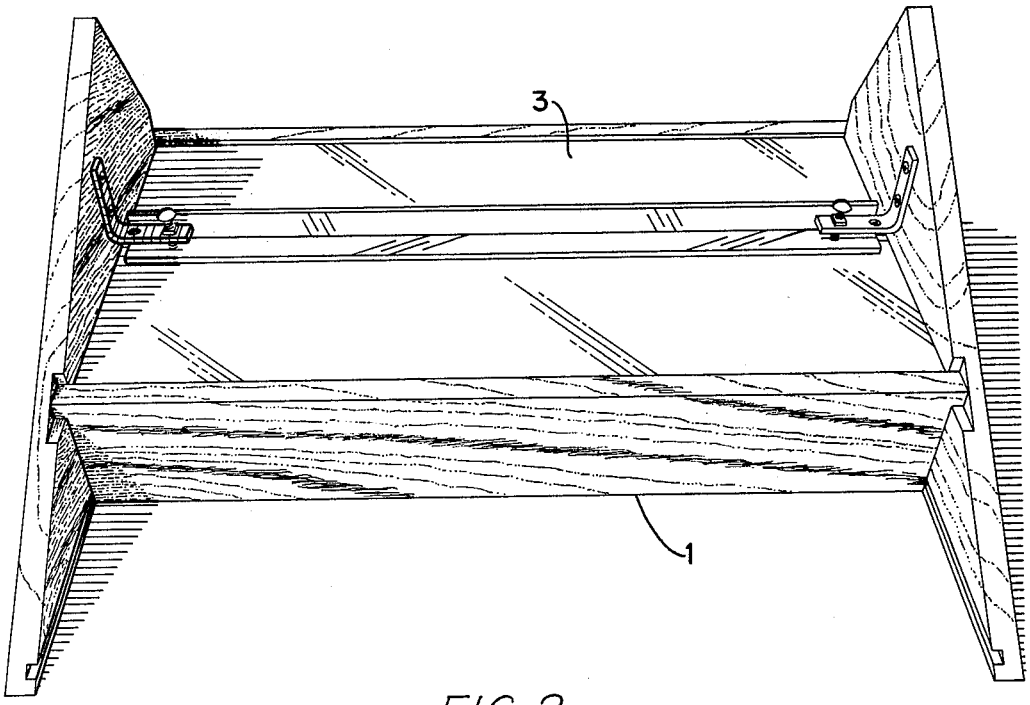

Referring to FIG. one it can be seen that the sundial described by this specification includes a transparent plate (2). Printed or inscribed upon this plate is an opaque or translucent design (4) such as a star, a cross-hair, a bull's-eye, or a combination thereof, said design indicating the geometric center of the transparent plate, and said design functioning as the gnomon of the sundial. Hereinafter the design (4) will be referred to as the gnomon. The sundial also includes a second plate (3) of an opaque or translucent material which has a set of hour curves, of which (6) is one, and a set of date curves, of which (7) is one, printed or inscribed upon it. Hereinafter this plate (3) will be referred to as the dial. The shadow (5) of the gnomon is cast by the sun upon the dial. Finally, the sundial includes a case (1) which holds the plates (2 and 3) parallel to each other and at a specific angle with respect to the ground, or horizon plane.

The sundial described in this specification consists primarily of a clear plate of glass with a shadow casting star printed on it, an opaque plate of plexiglass with a set of hour and date lines printed on it and a case which holds the two plates apart at a specific distance and at a specific angle with respect to the ground, (see FIG. one). Hereinafter said glass plate will be refered to as the "star plate" and the plexiglass dial plate will be refered as the "dial plate" or "dial".

By design, the star is fixed in position directly over the center of the dial plate at an arbitrary distance above it, and the two plates are held parallel to each other at this distance by the case. Also by design, the sundial is to rest on a level surface, and be oriented towards true north as shown in FIG. one. In this position, the center of the star acts as a "lens" by which the ecliptic and the sun are mapped onto the dial. The sun is directly mapped as the center of the shadow of the star and the ecliptic is indirectly mapped, mathematically, as the hour and date lines of the dial.

The time and date are read by referencing the shadow with respect to these curves. The time of day is read by the shadow's position on or in between the vertical hour curves. The hour curves are individual analemmas which correct for the changing difference between standard civil time and apparent solar time throughout the year according to the equation of time. During the course of a day, the shadow will track from left to right across the dial. When reading the time, the date is simultaneously read by the shadow's position on or between the horizontal date curves. The date curves represent the track of the shadow across the dial on the first day of each month of the year, according to the changing apparent declination of the sun in the celestial sphere. In the summer the shadow will track along the lower date curves as the apparent declination of the sun is then at a maximum. In the winter the shadow will track along the upper date curves as the apparent declination is then at a minimum. The middle curves are for spring and fall. Normally, both sets of curves are labled on the dial. These lables are omitted in FIG. one for the sake of simplicity.

The sundial is designed to be used in, and is therefore calibrated for, a specific arbitrary locale. First, the curves of the dial are mathematically corrected for the difference in apparent solar time between said locale and the next lesser ideal time zone boundry, where apparent solar time may be directly converted into civil time, employing the table for the Epemeris Transit given in the American Ephemerides and Nautical Alminac. Second, the case is designed to hold both star and dial plates perpendicular to the plane of the celestial equator at said locale, for reasons which will be explained later. Since the angle the plane of the celestial equator makes with respect to the ground plane or horizon at a specific locale is equal to the co-latitude of the locale, the angle of the case, star plate and dial with respect to the ground will necessarily be equal to the latitude of the locale. Therefore, the sundial is designed for a specific latitude and longitude, and as a result it is exceedingly accurate. At the center of said locale it is accurate to within plus or minus one minute standard civil time, throughout the year, when the shadow is centered on an hour line. The accuracy is reduced by one minute for each fifteen nautical miles of radius from the center of said locale.

The idea for the hour and date curves of the dial was disclosed to the applicant in the April 1975 issue of "Sky and Telescope" magazine, in an article entitled "A Sundial on an Office Ceiling", by William R. Schrader. The applicant makes no claim with respect to this idea. The hour and date curves are described for the sake of completeness, and also because a knowledge of how they work facilitates an understanding of the design of the case, which the applicant does make claim to. An explanation follows.

The range of hours the sundial is capable of is strictly limited by the diffusion of the shadow of the star. This is a function of the distance the shadow must travel from the star to any particular spot on the dial. The extreme hour curves are designed to be just less than the distance from the star which is the maximum the shadow is able to resolve satisfactorily. Thus, it is desirable that the hour curves be vertically parallel, as in FIG. one. If they were not, that is if they were divergent, the spacing of the hour curves would be wider in the winter (top of the dial) than in the summer (bottom of the dial), or else vice versa. Then either the range of the hours of winter would exceed the range the shadow was capable of resolving, or the range of the hours of summer would. As mentioned, the angle of the case is chosen so that the star plate and dial will be held perpendicular to the plane of the celestial equator at the locale for which the sundial is designed. Only at this angle will the celestial equator map as the horizontal middle line of the dial, (not shown). Since the angular range of the sun above or below the celestial equator throughout the year is equal, excepting for sign, the image of the sun—the shadow—will traverse an equal distance above or below the horizontal middle of the dial at this angle. As a result, the required set of hour curves will be vertically parallel, as required, and that is why this angle is chosen for the case.

When exposed to the sun for a period of time the plexiglass dial plate will get very hot, since it is opaque and of a dark color to avoid eye strain. Since the front surface is directly exposed to the sun while the rear surface is not, the front will expand more than the rear causing the dial plate to bow outwards towards the observer. This warping can affect the accuracy of the sundial by as much as ten minutes. This error is not acceptable. Therefore, the sundial has a rigid aluminum bar fastened to the center of the back of the plexiglass dial plate with epoxy cement. The bar and plate are pressed upwards in the case by bolts mounted through two angle brackets fastened to the sides of the case, as shown in FIG. two. This pressure flattens the dial plate. Also, the grooves in the case for the dial plate have enough play (depth) so that the dial plate can be moved in order to exactly center it with respect to the star. The nuts of the bolts are then tightened, locking the dial plate in place. The L-shaped aluminum bar greatly facilitates this adjustment, as it enables a firm grip on the dial. This completes the detailed description. Two claims are made in this application. They are:

I claim:

1. A sundial including a transparent plate of material adapted to face the sun, an opaque design printed on said transparent plate, and a dial, said opaque design functioning as the gnomon of the sundial, the shadow of which is cast onto the dial by the sun, said dial comprising an opaque plate of material which is held parallel to and at a fixed distance behind said transparent plate, said dial having a set of calibrated analemmae and solar declination markings printed on it whereby to provide a reference for determining the position of said shadow in order to tell the time of day and the approximate date of the year, said time of day being the correct Standard Time for the specific locale in which the sundial is designed to be used.

2. The sundial set forth in claim 1 including a case which is an integral part of the sundial, said case being designed for the specific locale in which the sundial is designed to be used, said case holding said transparent plate and dial parallel to each other at a fixed distance apart, perpendicular to the plane of the celestial equator and inclined to the plane of the horizon of said locale at an angle equal to the latitude of said locale, and said sundial being designed to be oriented such that said case holds said transparent plate and dial perpendicular to the plane of the meridian of said locale.

* * * * *